US006391126B1

(12) United States Patent
Engl et al.

(10) Patent No.: US 6,391,126 B1
(45) Date of Patent: May 21, 2002

(54) METHOD FOR PRODUCING AGING-RESISTANT STRIP FROM AN ALUMINUM-KILLED STEEL

(75) Inventors: Bernhard Engl; Klaus-Dieter Horn, both of Dortmund (DE)

(73) Assignee: Thyssen Krupp Stahl AG, Düsseldorf (DE)

( * ) Notice: Subject to any disclaimer, the term of this patent is extended or adjusted under 35 U.S.C. 154(b) by 0 days.

(21) Appl. No.: 09/671,644

(22) Filed: Sep. 28, 2000

(30) Foreign Application Priority Data

Sep. 30, 1999 (DE) ..... 199 46 889

(51) Int. Cl.[7] ..... C21D 8/02

(52) U.S. Cl. ..... 148/533; 148/602

(58) Field of Search ..... 148/533, 601, 148/602, 603

(56) References Cited

U.S. PATENT DOCUMENTS 5,656,102 A * 8/1997 Taylor et al. ..... 148/603
5,855,696 A * 1/1999 Tezuka et al. ..... 148/603

* cited by examiner

*Primary Examiner*—George Wyszomierski
(74) *Attorney, Agent, or Firm*—Max Fogiel

(57) ABSTRACT

In order to provide a cost-effective, time saving method for producing aging-resistant strip consisting of aluminum-killed steel, for which, initially, a strip is produced in the usual manner by rolling and the rolled strip is annealed continuously, the still hot strip is wound into a coil and cooled to room temperature, the strip, cooled in the coil, being finally finished.

4 Claims, 5 Drawing Sheets

METHOD FOR PRODUCING AGING-RESISTANT STRIP FROM AN ALUMINUM-KILLED STEEL

BACKGROUND OF THE INVENTION

The invention relates to a method for producing aging-resistant strip from an aluminum-killed steel. Such steel strip is used for hot-rolled strip or cold-rolled strip for producing cold-formed structural elements, such as car body parts, etc.

In the course of their production, steeled strip, in order to improve its properties after it has been produced in the usual manner by a hot rolling and an optionally required subsequent cold rolling, usually is subjected to an annealing treatment in a continuous annealing furnace. At the end of this annealing treatment, the strip frequently is subjected to a surface-finishing process, such as hot galvanizing. It is then cooled and subjected to a finishing rolling, until finally, wound into a coil, it is passed on to a further processing operation.

From the DE 35 28 782 A1, it is known that, for a method of producing an aging-resistant strip steel with increased economic efficiency, an iron slab is rolled, reeled, annealed in the continuous strip furnace and subsequently provided with a metallic coating, after which it is finished.

One problem with the procedure, which is summarized above, consists therein that the strip, produced in this way, does not have the aging-resistance required in practice. The premature aging causes a deterioration in the conversion properties of the strip so that, a short time after its production, its further processing becomes difficult or even impossible.

One possibility of eliminating the aging sensitivity of strip, produced from aluminum-killed steel, consists therein that the strip, after it has been annealed continuously, surface finished and cooled, is subjected to a box annealing and, only after this box annealing, is finished and wound into a coil. However, because of this interposed box annealing process, this procedure is costly and time consuming.

An attempt has therefore been made to produce strip with a low aging potential from the steels of the type in question in a continuous process without box annealing by a controlled cooling according to specified cooling processes. However, these attempts have not led to the desired result even when the annealing treatment was combined with an excessive aging treatment.

SUMMARY OF THE INVENTION

It is an object of the invention to provide a method for producing aging-resistant strip, consisting of. an aluminum-killed steel, cost-effectively and in a time-saving manner.

Starting out from the state of the art given above, this objective is accomplished by. a method for producing aging-resistant strip from an aluminum-killed steel, for which, initially, a strip is produced by rolling in the usual manner, the rolled strip is annealed continuously, the still hot. strip is then wound up into a coil and the strip, wound into a coil, is cooled to room temperature and finally finished.

Preferably, at the end of the continuous annealing, the strip is surface finished before, after leaving the surface finishing equipment, it is wound up into a coil in the still hot state. The inventive method leads to particularly good results if the strip, in the course of the surface finishing operation, is galvanized hot.

Contrary to the state of the art, the annealed and subsequently surface-finished strip, upon leaving the continuous annealing furnace and the surface finishing equipment, is not cooled in a separate operation in the case of the inventive method. Instead, it is wound into a coil while still warm. In the coil, the strip cools down slowly until it reaches room temperature. It is then subjected to a finishing rolling process.

It has been noted that the resistance to aging of strip of aluminum-killed steel, produced pursuant to the invention, is equal to that of strip, which has additionally been subjected to the continuous annealing treatment and the optionally carried out surface finishing of a box annealing. Surprisingly, it was possible to bring this about solely owing to the fact that the strip, taking along the temperature to which it is brought in the continuous annealing furnace or in the surface finishing equipment, such as the hot galvanizing equipment, is wound and subsequently cooled slowly to room temperature during a sufficiently long period of time. A controlled rapid cooling at the end of the annealing or the surface treatment and, associated with that, an over-aging treatment can thus be omitted for the inventive procedure, as can the box annealing. This makes it possible to produce, with the invention, an aging-resistant strip from an aluminum-killed steel at a low cost and with little expenditure of time.

If the surface finishing includes hot galvanizing, the temperature of the strip, existing at the end of the galvanizing: process, is very suitable for the winding of the coil, carried out pursuant to the invention immediately after the surface finishing.

As mentioned, it is essential that the strip, carrying along its temperature at the end of the annealing process or the surface finishing process, is wound into a coil and, wound in this manner into a solid coil, is cooled to room temperature. At the same time, the temperature, during the reeling of the annealed and surface-finished strip into a coil, should be between 150° C. and 350° C. By maintaining this temperature range for the winding temperature, it is ensured that, even a long time period after the strip is produced pursuant to the invention, the good properties of the strip are still present, so that the strip can be processed essentially unaffected by its age.

By cooling the coil in air, an optimum course of the temperature until room temperature is reached is ensured. Of course, the cooling can also take place in any other surrounding medium provided that the course of the cooling is comparable.

The invention is explained in the following by means of examples.

BRIEF DESCRIPTION OF THE DRAWINGS

Diagrams 1 to 9 show the values of different properties of strip, produced from different aluminum-killed steels, cold rolled and finished. The values have been related to the respective winding temperature.

DESCRIPTION OF THE PREFERRED EMBODIMENTS

Figure 1:
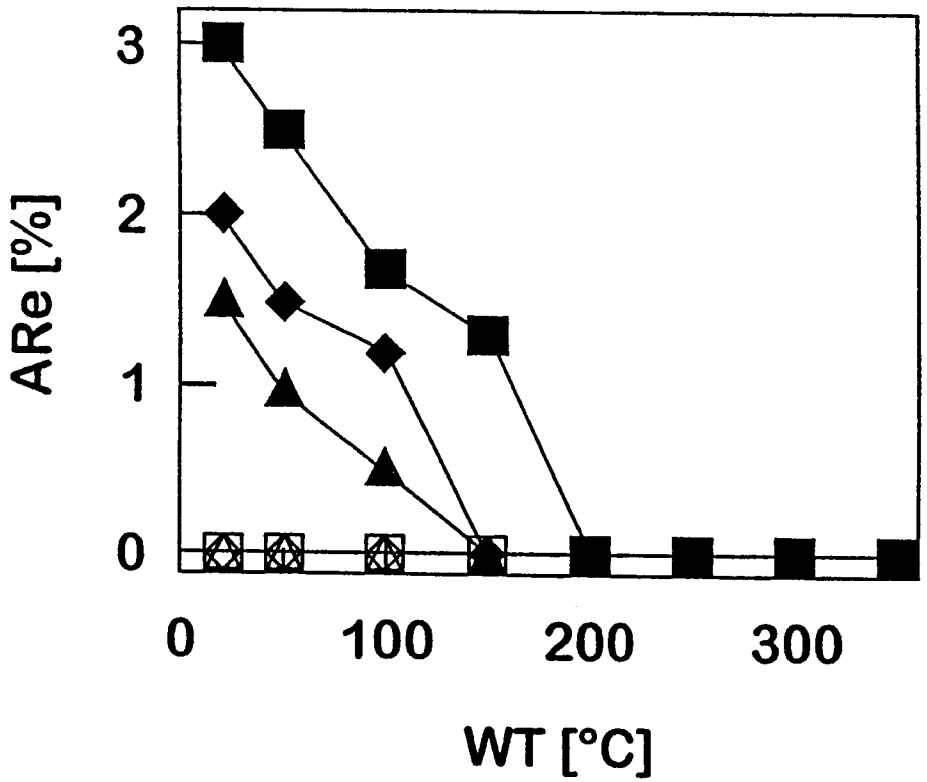
Figure 3:
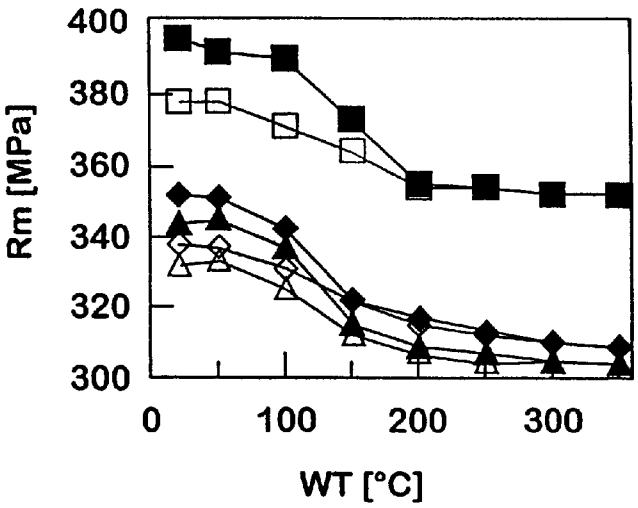
Figure 2:
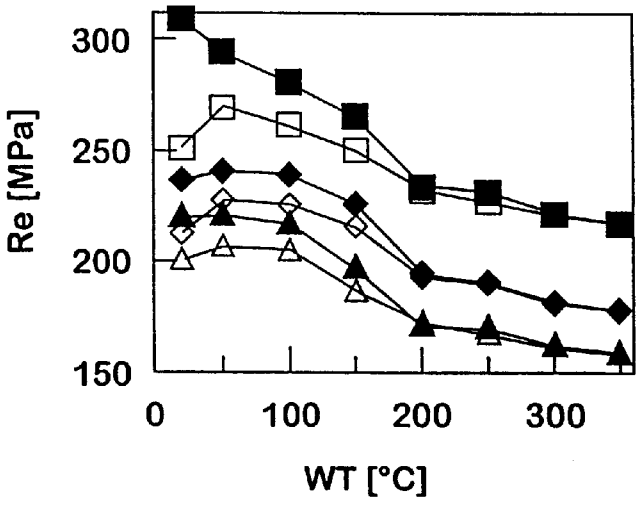
Figure 5:
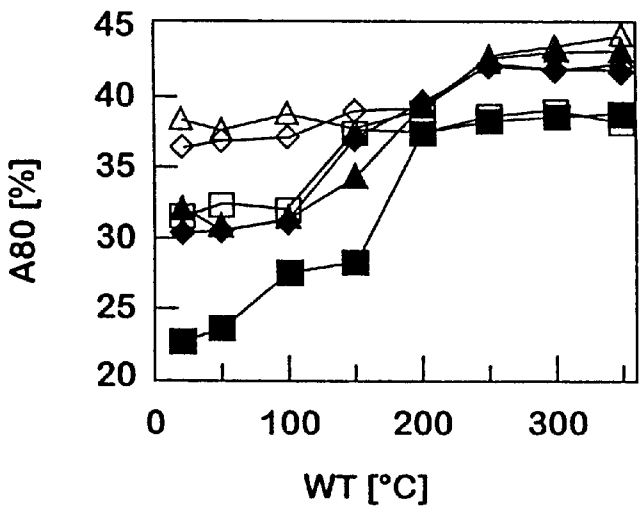
Figure 4:
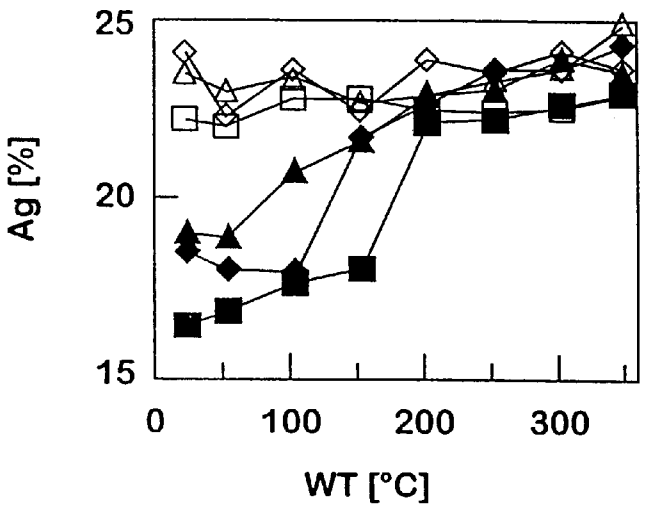
Figure 7:
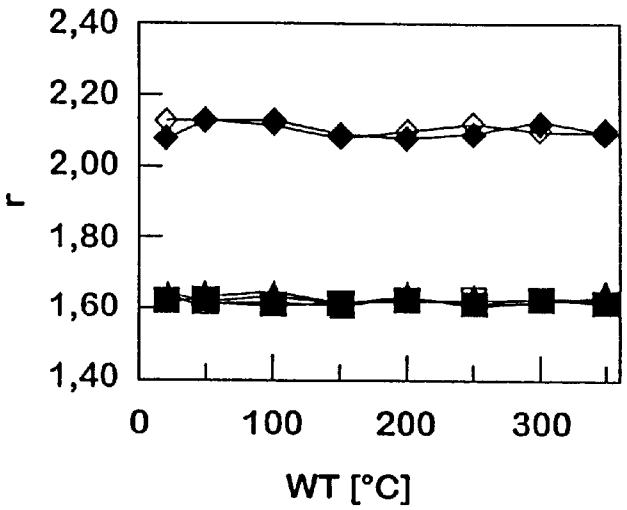
Figure 6:
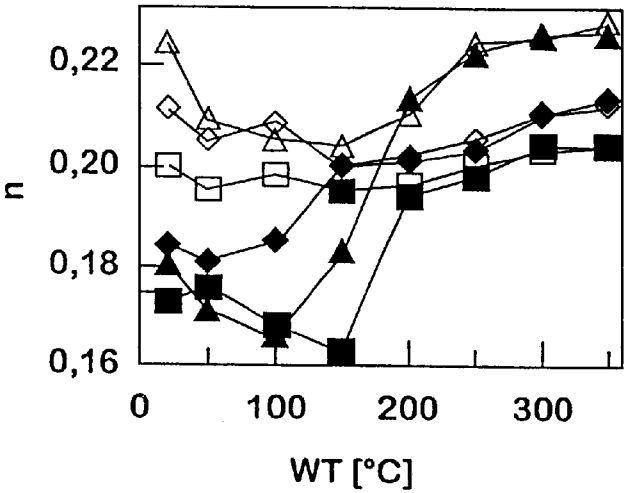
Figure 9:
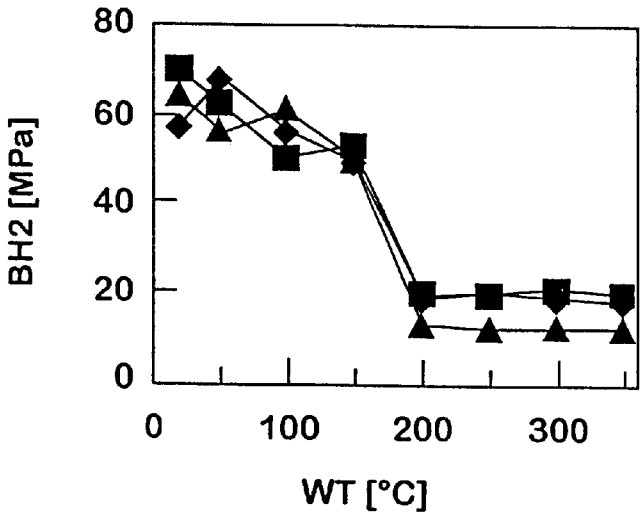
Figure 8:
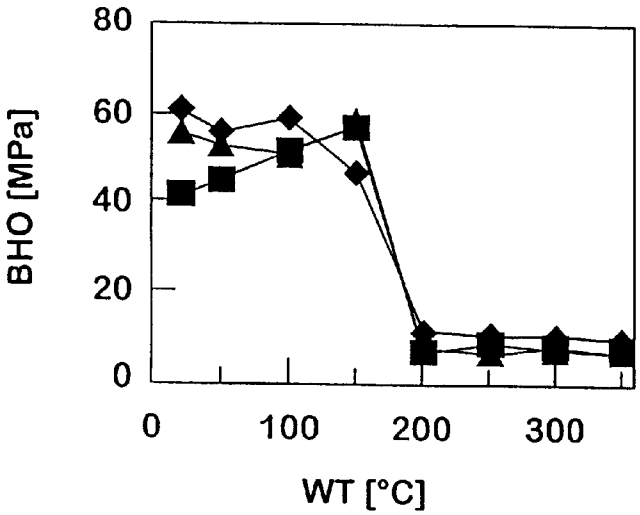

Strips $B_A$, $B_B$ and $B_C$ were produced in the usual manner from steels A, B and C, having the compositions given in the Table below, by hot rolling and subsequently by cold rolling.

| Steel | C | Si | Mn | P | S | Al | N |
|---|---|---|---|---|---|---|---|
| A | 0.04 | 0.158 | 0.206 | 0.023 | 0.008 | 0.034 | 0.0036 |
| B | 0.031 | 0.013 | 0.164 | 0.014 | 0.008 | 0.033 | 0.0026 |
| C | 0.021 | 0.014 | 0.162 | 0.007 | 0.008 | 0.033 | 0.0016 |

(contents given in % by weight)

The strips $B_A$, $B_B$, $B_C$ are annealed continuously in a continuous annealing furnace. Subsequently, their surfaces were subjected to hot galvanizing.

Upon leaving the hot galvanizing equipment, the strips $B_A$, $B_B$, $B_C$ were reeled at different winding temperatures WT of 50° C., 100° C., 150° C., 200° C., 250° C., 300° C. and 350° C. in each case into a coil. Subsequently, the coils were cooled to room temperature in air over a period of up to 24 hours.

The cooled strips $B_A$, $B_B$, $B_C$ are finished rolled, the degrees of finish rolling being maintained between 0.3% and 1.5%.

Subsequently, the strip was heated for 1 hour at 100° C., in order to bring about artificial aging. In the tensile strength diagram, which was prepared by a tensile strength test conducted immediately after the artificial aging, the optimally finish rolled strips $B_A$, $B_B$, $B_C$ showed no yield point elongation when a suitable winding temperature WT was selected.

In Diagrams 1 to 9, the values of the respective property, obtained for the strip $B_A$, produced from steel A, are shown by squares, the values of the respective property, obtained for strip $B_B$, produced from steel B, are shown in each case by diamonds and the values of the respective property, obtained for strip $B_C$, produced from steel C, are in each case shown by triangles. The values, existing after the finish rolling, are shown by empty squares, diamonds and triangles, while the values, obtained after artificial aging, are shown by filled squares, diamonds and triangles.

In Diagram 1, the yield point elongations ARe are given in percent as a function of the respective winding temperature WT in °C. It can be seen that, immediately after the finish rolling, the strips $B_A$, $B_B$ and $B_C$ are free of stretching elongation. However, a strip $B_A$, wound at a winding temperature WT of 20° C., has a yield point elongation ARe of 3% in the aged state. Likewise, strip $B_B$, wound at this winding temperature WT of 20° C., has a yield point elongation of 2%, while the yield point elongation for strip $B_C$ is about 1.5%. On the other hand, at a winding temperature WT of at least 200° C., all strips $B_A$, $B_B$ and $B_C$ are free of a yield point elongation even in the aged state; for strips $B_B$, $B_C$, this condition is achieved already at 150° C.

In Diagram 2, the yield points RE in MPa are given as a function of the winding temperature WT in °C. for the respective strips $B_A$, $B_B$, $B_C$, while the values of the tensile strength Rm in MPa are shown in a corresponding manner in Diagram 3. It can be seen that, at a winding temperature of at least 200° C., an aging-related increase in the yield point or in the tensile strength of the aged strips $B_A$, $B_B$, $B_C$ in comparison to the corresponding values of strips $B_A$, $B_B$, $B_C$, which have not been aged but have been finished rolled, cannot be detected.

In Diagram 4, the values of the elongation before reduction in area Ag is given in percent as a function of the winding temperature WT in °C. for the respective strips $B_A$, $B_B$, $B_C$, while in Diagram 5, in a corresponding manner, the values of the elongation at break A80 are shown as a percentage. It turns out that, at a winding temperature WT of less than 150° C., the elongation values of the artificially aged strips $B_A$, $B_B$, $B_C$ are clearly less than the elongation values of the strips $B_A$, $B_B$, $B_C$ immediately after the finish rolling. On the other hand, above a winding temperature WT of at least 200° C., there is hardly any decrease in the elongation values in the course of the aging of the strips $B_A$, $B_B$, $B_C$. For example, for the strips $B_A$, $B_B$, $B_C$, wound at a temperature of 250° C., elongations at break A80 of 42 to 44% were achieved after artificial aging.

In Diagram 6, the n value is given as a function of the winding temperature WT in °C. for the respective strips $B_A$, $B_B$, $B_C$. It is seen that, at a winding temperature WT of at least 150° C., there is a great decrease in the n value in the course of the aging. However, at winding temperatures WT of at least 200° C., there is practically no longer any identifiable effect of aging. It is remarkable that, for example, a strip $B_C$, produced from steel C and wound at a winding temperature WT of more than 250° C., reaches n values of more than 0.22.

In Diagram 7, the r value is given as a function of the winding temperature WT in °C. for the strips $B_A$, $B_B$, $B_C$. It can readily be seen that aging does not cause any change in the r value and, accordingly, the winding temperature WT also does not have an effect on the r value.

Finally, the BH0 value is given as a characteristic quantity of the bake-hardening properties in Diagram 8 and the BH2 value, in each case in MPa, is given in Diagram 9 as a function of the respective winding temperature WT in °C. It can be seen that, in the artificially aged state, at winding temperatures WT of less than 150° C., BH0 values of about 40 to 60 MPa and BH2 values of about 50 to 70 MPa are attained for all strips $B_A$, $B_B$, $B_C$. At a winding temperature WT of at least 200° C., the BHO value for all strips $B_A$, $B_B$, $B_C$ drops off to values of about 10 MPa. At these winding temperatures WT, BH2 values of about 20 MPa are attained for strips BA and $B_B$, produced from steels A and B, while RH2 values of 10 MPa are obtained for strip $B_C$ obtained from steel C.

It can thus be seen from Diagrams 1 to 9 that, using the inventive procedure, cold rolled, continuously annealed and finished strip of aluminum-killed steels can be produced, which do not age. This is achieved owing to the fact that the strip, immediately after the continuous annealing, is wound at winding temperatures of at least 150° C. and cooled slowly in air at a cooling rate of not more than 1° C. per minute. If this procedure is employed, the properties of the strip in the aged state approximate the properties of the strip, immediately after it is produced. The strip, produced pursuant to the invention, has a good bake hardening potential.

By a combination of the inventive method with suitable hot and cold methods for producing strip, steel strip of the type in question can be produced with especially outstanding properties, such as the lowest yield points, etc.

What is claimed is:

1. A method for producing aging-resistant strip from aluminum-killed steel, comprising the steps of:

producing a rolled strip by rolling;

annealing continuously said rolled strip subsequently;

surface finishing said strip after being annealed continuously;

galvanizing hot said strip during said surface finishing step;

winding said strip into a coil while still hot;

cooling said strip to room temperature while wound on said coil; and finishing the cooled strip in said coil.

2. A method as defined in claim 1, wherein said strip is wound into said coil at a temperature between 150° C. and 350° C.

3. A method as defined in claim 1, wherein said coil is cooled in air.

4. A method as defined in claim 1, wherein said cooling is at a cooling rate of less than 1° C. per minute.

* * * * *